United States Patent [19]

Schwarzenbek

[11] 4,158,622

[45] Jun. 19, 1979

[54] TREATMENT OF HYDROCARBONS BY HYDROGENATION AND FINES REMOVAL

[75] Inventor: Eugene F. Schwarzenbek, Lavalette, N.J.

[73] Assignee: Cogas Development Company, Princeton, N.J.

[21] Appl. No.: 876,014

[22] Filed: Feb. 8, 1978

[51] Int. Cl.[2] ..... C10G 23/00

[52] U.S. Cl. ..... 208/177; 208/210; 208/213; 208/254 H

[58] Field of Search ..... 208/143, 157, 10, 162, 208/177, 213, 254 H; 260/449.6

[56] References Cited

U.S. PATENT DOCUMENTS

| | | | |
|---|---|---|---|
| Re. 25,770 | 4/1965 | Johanson | 208/10 |
| 2,779,777 | 1/1957 | Mungen | 260/449.6 |
| 3,321,393 | 5/1967 | Schuman et al. | 208/10 |
| 3,410,792 | 11/1968 | Van Driesen et al. | 208/143 |
| 3,519,553 | 7/1970 | Johanson et al. | 208/10 |
| 3,519,554 | 7/1970 | Stotler et al. | 208/10 |
| 3,519,555 | 7/1970 | Keith et al. | 208/10 |
| 3,523,888 | 8/1970 | Stewart et al. | 208/143 |
| 3,594,305 | 7/1971 | Kirk, Jr. | 208/10 |
| 3,640,816 | 2/1972 | Bull et al. | 208/10 |
| 3,679,573 | 7/1972 | Johnson | 208/10 |

*Primary Examiner*—George Crasanakis

*Attorney, Agent, or Firm*—Fitzpatrick, Cella, Harper & Scinto

[57] ABSTRACT

Hydrocarbonaceous material produced from pyrolysis of coal and shale is subjected to hydrogenation and fines removal by first passing it through an ebullating bed reactor in which the hydrocarbonaceous material is partially hydrogenated and partially vaporized. The vapor is then separated and further hydrogenated while the fines in the liquid portion are concentrated and removed as a slurry. The remaining liquid is vaporized, either by recycling it through the ebullating bed reactor or by flash evaporation, to rid it completely of fines. The thus vaporized remaining liquid is also subjected to further hydrogenation.

17 Claims, 4 Drawing Figures

Recycle Gas
Purge Gas
50
46
Low Temp Separator
42
44
Treated Product (Liquid)
Fixed Bed Reactor
38
40
Cooler
36
14
Separator Settler
14a
14b
28
30
Slurry Product
32
26
24
Ebullating Bed Reactor
12
34
Heavy Oil Purge
46
22
56
58
52
54
High Temp Separator Settler
59
20
Ebullating Bed Reactor
10
48
18
16
$H_2$ Feed
Coal Shale Tar Sands, Oil Feed Recycle Gas
Purge Gas
Treated Product (Liquid)
Low Temp Separator
Fixed Bed Reactor
Cooler
Water
Separator
Purge Gas
Cooler
Flash Evaporator Tank
Slurry Discharge
Steam Feed
Vapor-Liquid Separator
Ebullating Bed Reactor
$H_2$ Feed
Coal, Shale Tar Sands, Oil Feed
10
14
14a
14b
16
18
28
30
38
40
42
44
46
48
50
60
62
64
66
68
72
74
76
78
80
82

TREATMENT OF HYDROCARBONS BY HYDROGENATION AND FINES REMOVAL

BACKGROUND OF THE INVENTION

1. Field of the Invention

This invention relates to the processing of hydrocarbonaceous materials and more particularly it concerns the hydrogenation of these materials which contain solid material in the form of fines and the removal thereof in the course of the hydrogenation process.

2. Description of the Prior Art

It is known to produce hydrocarbonaceous materials such as oils, tars and waxes from the pyrolysis of coal and shale and from the extraction of tar sands. Hydrocarbonaceous materials which are produced in this manner, however, are not useful for most applications without further processing. This further processing usually involves hydrogenation, i.e., subjecting the hydrocarbonaceous material to hydrogen gas at high pressure and high temperature in the presence of a solid catalyst such as a metal salt or oxide. The hydrogenation process serves to break down the larger heavier organic molecules in the hydrocarbonaceous material by displacement of atoms of oxygen, nitrogen and sulfur (known as "hetero atoms") which link together submolecules. The displacement of these hetero atoms results in the production of mixtures of lighter weight lower viscosity and lower boiling point oils which can be separated from each other by fractionation.

In general, the aforesaid hydrogenation takes place in a heavy wall reactor which is maintained at a high pressure, e.g., 1000 to 10,000 pounds per square inch (70 to 700 kilograms per square centimeter). The reactor contains one or more beds of granulated catalyst material and the hydrocarbonaceous material and hydrogen gas together are passed through these beds. Some reactors are known as a fixed bed type and in those reactors the feed and hydrogen gas flow downwardly through each bed. Other reactors are known as the fluidized or ebullating bed type and in those reactors the feed and hydrogen gas flow upwardly through the catalyst material at sufficient velocity to maintain the individual catalyst particles in a state of suspension. Ebullating bed type reactors suitable herein are those used for processing oil which has been extracted from slurrys of coal shown and described in U.S. Pat. Nos. Re. 25,770, 3,321,393, 3,519,553, 3,519,555, 3,594,305 and 3,679,573. The fixed bed type of reactor permits the incorporation of several beds in a single housing so that successive stages of reaction can be carried out economically. The ebullating bed reactor, on the other hand, permits better contact between the feed, the hydrogen and the catalyst. Furthermore, the ebullating bed reactor is less susceptible to plugging or clogging by the accumulation of small particles of solid material, i.e. "fines" which are carried into the reactor with the incoming hydrocarbonaceous feedstock.

The prior art has failed to provide a satisfactory technique for removing fines from hydrocarbonaceous products. This is a serious problem in the processing of such materials produced from the pyrolysis of coal and shale or which have been extracted from tar sands, the materials normally contain two to five percent or more of fines. These fines can plug a fixed bed reactor. Also, because of vaporization which occurs in the course of operation of both fixed and ebullating bed reactors the fines concentration in the remaining liquid increases substantially so that plugging can become a problem in each type of reactor. In addition, unless the fines are eventually removed the resulting product oil will be unsuitable for most applications.

It is not practical to remove fines from coal pyrolysis or tar sands oil prior to hydrogenation because at this point the hydrocarbonaceous material is so thick and viscous that the fines cannot be segregated. Furthermore, the removal of fines from the hydrogenated product has not proven satisfactory because such removal requires small pore filters which clog very quickly and which must be replaced at frequent intervals.

It is, of course, known that solids may be separated from liquids by vaporizing the liquid, conducting the vapors to a different location and condensing the vapors. This technique, however, cannot readily be carried out prior to hydrogenation because the boiling point of many of the constituents of the coal pyrolysis oil is very high. On the other hand, although vaporization does occur during the hydrogenation process itself, the fines which are separated in the hydrogenation reactor will accumulate therein and will eventually clog the reactor.

SUMMARY OF THE INVENTION

The present invention avoids the above described problems and permits the complete hydrogenation of hydrocarbonaceous materials and the removal of fines therefrom in a convenient and economical manner. According to the present invention the hydrocarbonaceous material to be treated is first subjected to partial hydrogenation in a first ebullating bed reactor means during which a portion of the hydrocarbonaceous material is vaporized. The amount of vaporization which occurs during this initial partial hydrogenation step is controlled to maintain enough liquid flowing through the reactor to carry all of the fines along with it. The liquid portion is then separated from the vapors produced in the reactor and the vapors are passed through a further reactor to complete their hydrogenation. The fines, which are entrained in the liquid portion, are concentrated to form a slurry which is ejected. The remainder of the liquid portion is then subjected to vaporization to separate it from retained fines and the remainder liquid portion is also subjected to further hydrogenation. The fines concentration may be carried out by allowing them to settle in the liquid portion or by centrifuging the liquid portion. The thus concentrated fines are ejected as a slurry and the remainder of the liquid portion is recycled through the ebullating bed reactor means. Alternatively, the liquid portion may be subjected to flash evaporation and the thus vaporized portion may be transferred to a further reactor to complete its hydrogenation.

There has thus been outlined rather broadly the more important features of the invention in order that the detailed description thereof that follows may be better understood, and in order that the present contribution to the art may be better appreciated. There are, of course, additional features of the invention that will be described more fully hereinafter. Those skilled in the art will appreciate that the conception on which the invention is based may readily be utilized as the basis for the design of other arrangements for carrying out the purposes of this invention. It is important, therefore, that the disclosure of this specification be regarded as including such equivalent arrangements as do not depart from the spirit and scope of the invention.

BRIEF DESCRIPTION OF THE DRAWINGS

Several preferred arrangements for carrying out the invention have been chosen for purposes of illustration and description in the accompanying drawings which form a part of the specification and wherein.

DETAILED DESCRIPTION OF THE PREFERRED EMBODIMENTS

Figure 1:
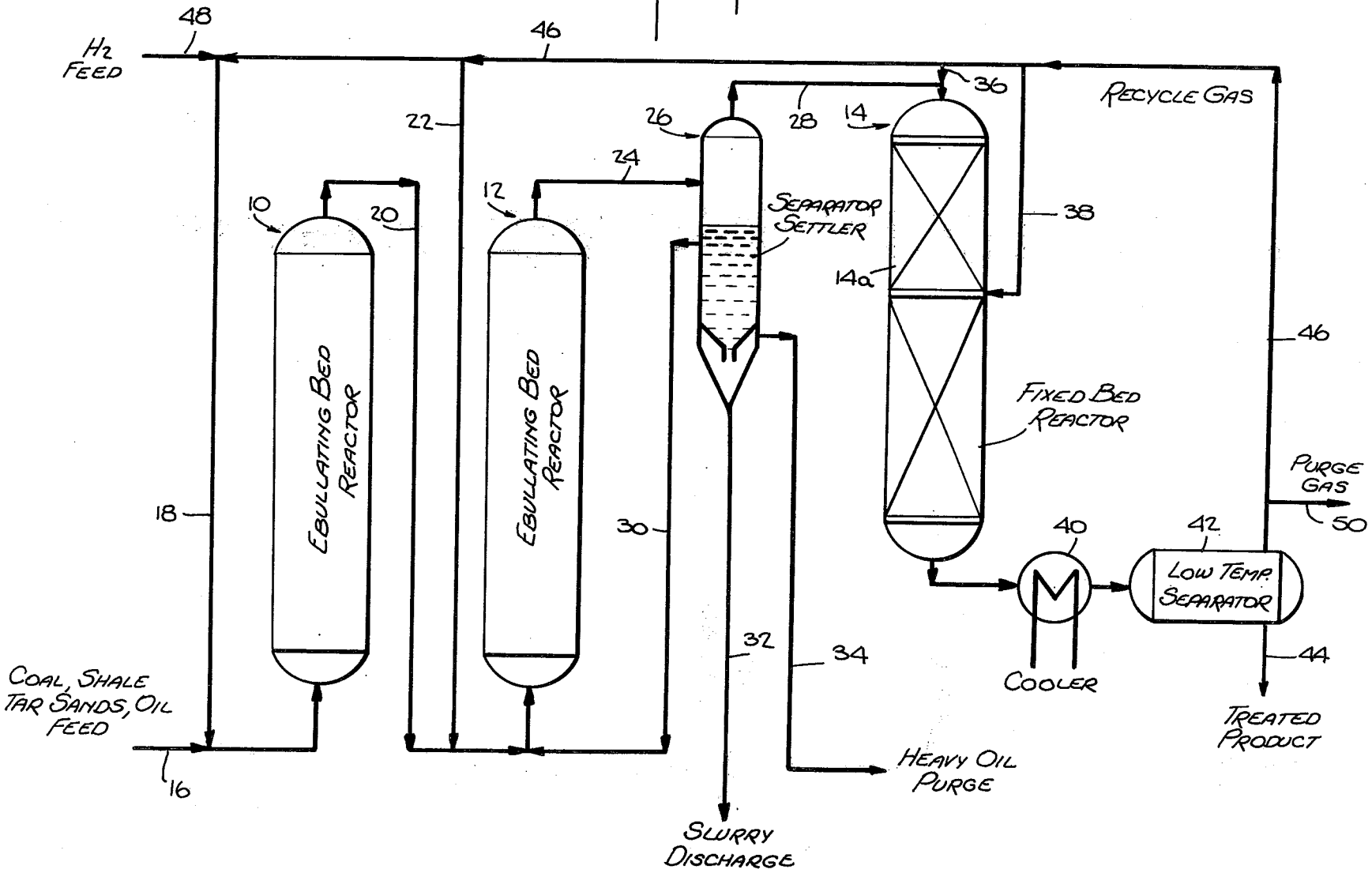
FIG. 1 is a diagrammatic representation of a system for processing oils according to the present invention.

In the system of FIG. 1 there are provided first and second ebullating type bed hydrogenation reactors 10 and 12 and a two stage fixed bed hydrogenation reactor 14. The specific construction of the ebullating bed reactors 12 and 14 is described in the prior art, for example in the aforementioned U.S. Pat. Nos. Re. 25,770 and 3,519,555. These reactors are essentially pressure containment vessels which are charged with a solid granular catalyst material such as, for example, cobalt molybdate on alumina. The catalyst material may be in the form of particles having a particle size of about 14–16 mesh, for example. The fixed bed reactor 14 is similar to the ebullating reactors; however, the catalyst material remains stationary in vertically separated beds 14*a* and 14*b*. While two beds are shown in FIG. 1 a larger number may be used.

Hydrocarbonaceous material which has been produced from the pyrolysis of coal or shale or which has been extracted from tar sands is supplied via a supply line 16 and is combined with hydrogen gas supplied via a hydrogen feed line 18. This mixture of hydrocarbonaceous material and gas is introduced into the bottom of the first ebuliating bed reactor 10 and passes upwardly between and in contact with the catalyst particles in the reactor. The temperature and pressure in the reactor are maintained high enough to promote hydrogenation of the hydrocarbonaceous feed as it moves through the reactor. A temperature of about 800° F. (425° C.) and a pressure of about 2000 psi (140 kg/cm$^2$) may be employed. These temperatures and pressures may vary considerably, e.g., from 750°–900° F. (400°–480° C.) and from 1500 to 3000 psi (105–210 kg/cm$^2$).

The catalyst particles in the reactor 10 are maintained in a state of continuous agitation by the flow of fluids up through the reactor. This serves to ensure that a maximum amount of catalyst surface area is presented to the reacting fluids for promoting the hydrogenation reactions. The fluidization of the catalyst particles also keeps each particle separated and allows the liquid portion of the fluids flowing through the reactor to carry any solid particles, or fines, up through the reactor without clogging it.

During the hydrogenation process in the reactor 10 a portion of the "hetero" atoms, i.e., atoms of oxygen, nitrogen and sulfur, which form bonds holding together the heavier molecules of the incoming hydrocarbonaceous material, are displaced by hydrogen atoms from the hydrogen gas. As a result, lighter weight hydrocarbon compounds are formed. Several of these compounds have lower boiling points than the original hydrocarbon feed and, in spite of the high pressure in the reaction chamber, a substantial percentage of them are converted to vapor. These vapors along with the remaining liquid portion, which carries with it all of the fines, and the remaining hydrogen gas are all directed, via a transfer line 20, to the bottom of the second ebullating bed reactor 12. Supplemental hydrogen gas is added to the transferred mixture via a supplemental hydrogen supply line 22.

Further hydrogenation takes place in the second ebulating bed reactor 12; but again care is taken to control the reaction conditions, i.e., pressures and temperature, and the residence time of the fluids during this further hydrogenation to ensure that a sufficient portion of the hydrocarbonaceous material being processed remains in liquid form to carry the entrained fines up and out of the second reactor. In most cases the temperatures and pressures in the second ebullating bed reactor 12 are maintained generally the same as those in the first reactor 10. The amount of liquid needed to carry fines up through the two reactors depends upon the viscosity of the liquid, its velocity and the size and density of the fines particles. In general, however, the fines should be in the range of ten to twenty-five percent by weight of the remaining liquid, and preferably less than twenty percent. Thus where the fines amount to two percent of the incoming liquid, ninety two percent of the incoming liquid may be converted to vapor in the two ebullating bed reactors. In order to maintain sufficient liquid in the ebullating bed reactors to carry fines through them the operating conditions must be maintained such that hydrogenation is not completed in these reactors. This further hydrogenation takes place in the stationary bed reactor 14.

The liquid product with entrained solids, and the accompanying vapors and gases from the second ebullating bed reactor 12 are transferred out from the top thereof, via a separator line 24 to a first separator unit 26. The gases and vapors which enter into the separator unit rise to its top and are transferred out, via a fixed bed reactor supply line 28, to the upper end of the fixed bed reactor 14. The liquid portion of the fluids which flow into the separator unit 26 remain therein for a period of time in a relatively quiescent state so that the entrained fines, which may constitute approximately twenty percent by weight of these fluids, can settle and form a slurry at the bottom of the separator unit. The remaining liquid, which has thus been relieved of a substantial portion of its entrained fines, is returned, via a recycle line 30 to the bottom of the second ebullating bed reactor 12. This recycled liquid, which contains a finite amount of retained fines, is combined with the liquids and gases from the transfer line 20 and the supplemental hydrogen supply line 22 and passes with them up through the reactor. The slurry which is formed in the bottom of the separator unit 26 is ejected from the bottom thereof via a slurry discharge line 32. This slurry may be used as a fuel.

Most of the recycled material becomes vaporized in the ebullating bed reactor 12 and it is thereby separator from the fines which had not been removed in the first separator unit 26. The vapors thus produced pass through the first separator unit 26 and are then transferred to the fixed bed reactor 14 for further hydrogenation.

The recycling of liquid through the second ebullating bed reactor 12 and the separator unit 26 may result in a buildup or accumulation in the separator unit of heavy oils which are incapable of being further broken down by hydrogenation in the reactor 12. In order to keep the system operating effectively when this occurs some of the accumulated heavy oils are extracted via a heavy oil purge line 34. This heavy oil may also be burned.

The liquids which are recycled from the first separator unit 26 and which are directed back through the second ebullating bed reactor 12 eventually become vaporized in the reactor. In the course of such vaporization a further fines separation takes place and the fines which had been retained in the recycled liquid are transferred to the non-vaporized or liquid portion of the fluids flowing up through the reactor. The vapors which are produced from the recycled liquids also pass into the upper region of the first separator unit 26 and are transferred via the fixed bed reactor supply line 28 to the upper end of the fixed bed reactor 14.

The vapors which pass into the fixed bed reactor 14 are completely free of fines so that the clogging problem caused by fines buildup is eliminated. Hydrogen gas is supplied via separate hydrogen gas lines 36 and 38 to each of the stages of the fixed bed reactor 14. By supplying additional hydrogen gas to each stage of the fixed bed reactor it is possible to control the temperature in the reactor. The additional hydrogen gas may also serve to compensate for the dilution and partial pressure loss of the hydrogen gas in the reactor by the other gases which are released from the vapors during the hydrogenation process. The temperature in the fixed bed reactor is maintained in the range of 700°-800° F. (370-425° C.) while the pressure is maintained slightly less than that in the ebullating bed reactors.

Finally, hydrogenated oil vapor are withdrawn from the bottom of the fixed bed reactor 14 and are transferred to a cooler 40 where they are condensed into a liquid. This liquid, along with the accompanying gases which do not condense in the cooler, is transferred to a low temperature separator 42 where the liquid product is separated from the uncondensed gases. The liquid product is withdrawn from the separator 42 via a treated product line 44 while the gases are withdrawn via a gas recycle line 46.

The gases which are withdrawn from the low temperature separator 42 include hydrogen gas and other gases which had been formed in the hydrogenation process, e.g. methane, etc. These gases are recycled via the gas recycle line 46 and are combined with make up hydrogen gas from an external hydrogen gas supply line 48. The make up and recycled hydrogen gases are combined and fed into the hydrogen fuel line 18, the suplemental supply line 22 and the separate gas supply lines 36 and 38.

Because of the hydrogen gas recycling, and the generation of other non-condensed gases in the hydrogenation reactions, a buildup of these other gases occurs. In order to limit the amount of this buildup, a portion of the recycle gas is removed via a gas purge line 50.

It will be appreciated from the foregoing description that all of the hydrocarbonaceous material, except for a very small percentage which is used to form a fines slurry in the separator unit 26 and possibly another small percentage which is not amenable to gravity reduction in the ebullating bed reactors, is fully converted to vapor and is fully hydrogenated in the fixed bed reactor 14; and the resulting product is essentially free of fines.

Figure 2:
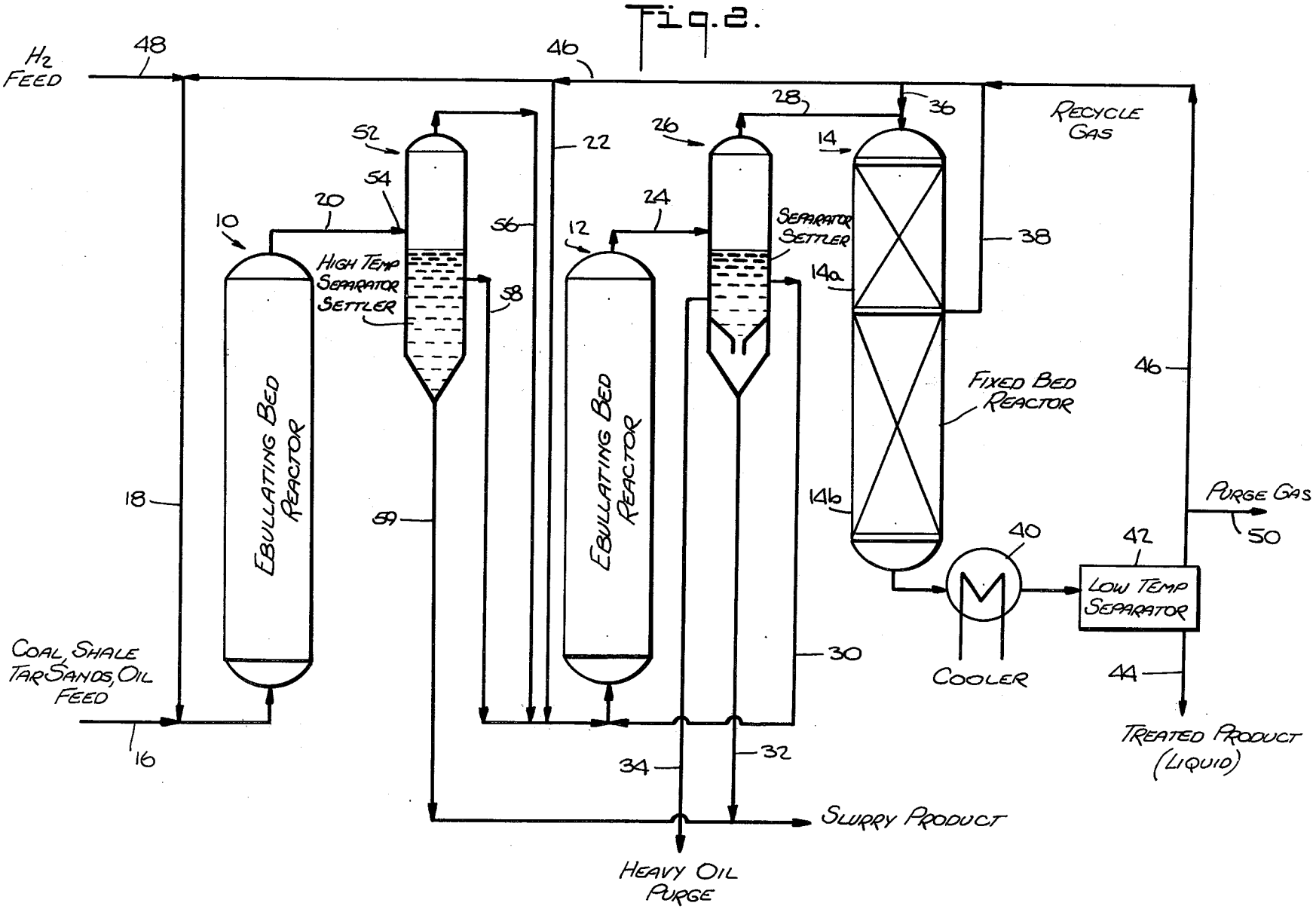
FIG. 2 is a view similar to FIG. 1 and showing a first modification.

FIG. 2 shows a modification of the system of FIG. 1 which may be used where the incoming feed contains a higher percentage of fines, e.g., five percent. The system of FIG. 2 is like the system of FIG. 1 except that in the FIG. 2 system an intermediate separator unit 52 is interposed in the transfer line 20 between the first and second ebullating bed reactors 10 and 12. The intermediate separator unit 52 is similar to the first separator unit 26 and it is provided with an input 54 to which the transfer line 20 from the first reactor 10 is connected and a vapor outlet 56 and a liquid outlet 58 which are both connected and feed into the bottom of the second ebullating bed reactor 12. The intermediate separator unit 52 is also provided with a slurry discharge line 59 for discharge of the fines slurry which settles in the bottom of the unit. This slurry discharge, as shown, may be ejected along with the slurry discharge 32 of the first separator unit 26.

It will be appreciated that with the modification of FIG. 2 a portion of the fines are removed from the liquid before it enters the second ebullating bed. Preferably 90% of the incoming fines are removed in the first separator and the remaining fines are removed in the second separator. This permits one to operate the first reactor such that its fluid products include 75% vapor and the second reactor such that its products include 95% vapor while the percentage of fines carried by the remaining liquid portion out of each reactor does not exceed 20%. Consequently, the incoming liquid may have as much as 5% fines and yet 95% of the hydrocarbonaceous feedstock may be converted to vapor in the first two reactors without either of the reactors becoming clogged or plugged due to lack of sufficient liquid to carry the fines through them. It will be appreciated also that this arrangement does not require a very high percentage of liquid to be recirculated through the second reactor.

The vapor portion of the partially hydrogenated oil from the second ebullating bed reactor 12 is separated in the second separator and is further processed in the fixed bed reactor 14 as in the preceding embodiment.

In some instances it may be desired not to recycle the liquid product from the ebullating bed reactor and yet since this liquid product may comprise 80% or more by weight of partially hydrogenated oil it would be uneconomical to discard it. The system of FIG. 3 permits the further processing of the liquid portion of the ebullating bed reactor product and separation of remaining fines.

Figure 3:
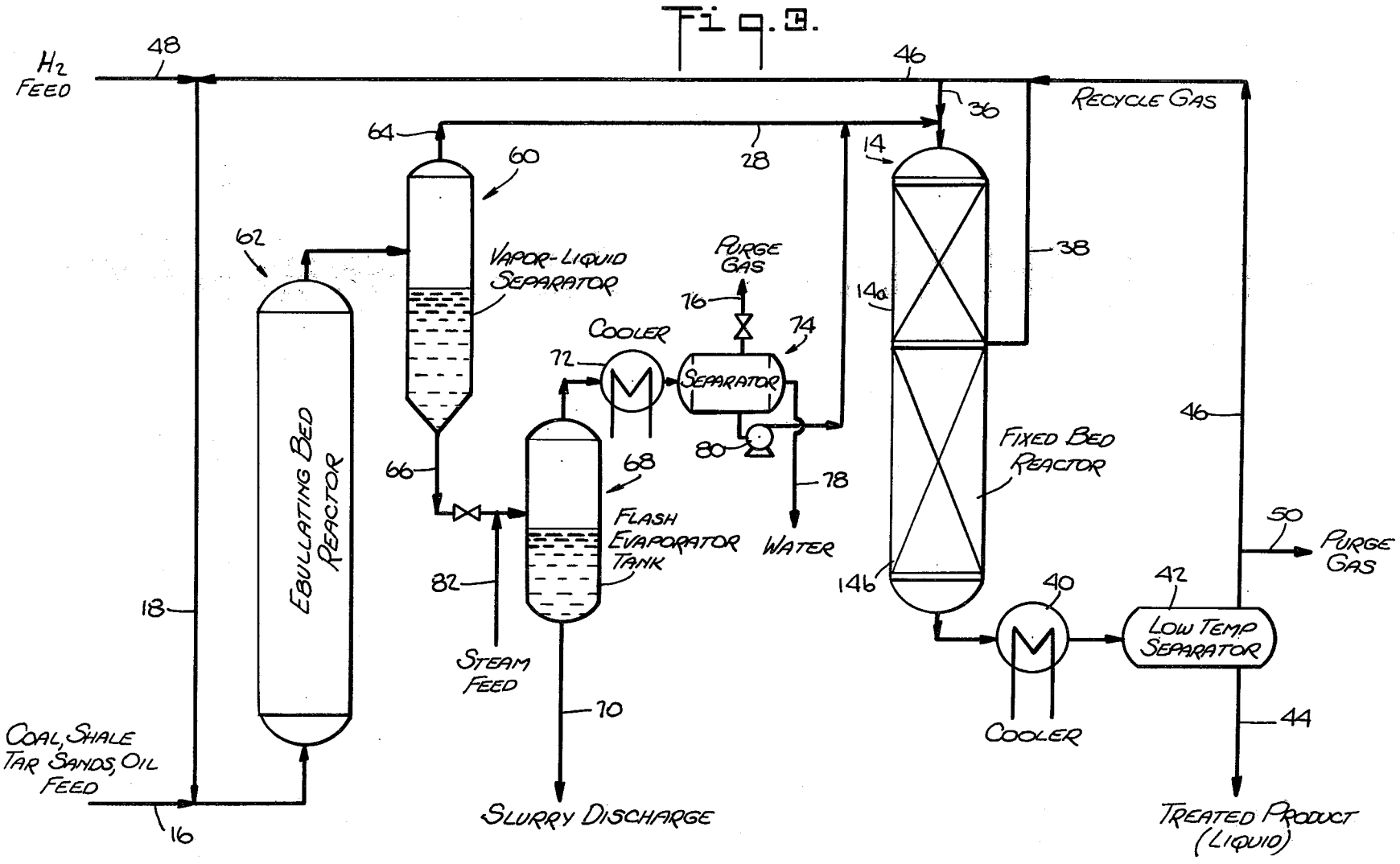
FIG. 3 is a view similar to FIG. 1 and showing a second modification.

As shown in FIG. 3 there is provided a vapor-liquid separator 60 which is connected to receive the output of an ebullating bed reactor 62. This vapor-liquid separator has a pure vapor outlet 64 at the top thereof and a lower liquids/fines outlet 66 at the bottom. No substantial concentration of fines takes place in the separator 60. The vapors from the separator 60 are transferred to the fixed bed reactor 14 as in the preceding embodiments. The liquids and fines which pass out through the lower outlet 66 however are transferred to a flash evaporator tank 68. This tank is maintained at a pressure less than the vapor pressure of the various constituents of the liquids which are supplied to it so that when these liquids enter into the tank 68 a substantial portion will flash into vapor. The liquid portion which does not flash into vapor becomes cooled in the process and settles in the bottom of the tank 68 along with the fines to form a slurry containing approximately 50% by weight of fines. This slurry is ejected via a slurry discharge line 70 and may be used as fuel. The vapors which are formed in the tank 68 are transferred out from the top thereof to a cooler 72 where they become condensed. The cooler output is then transferred to a further separator 74 which allows the uncondensed gases and the non-hydrocarbon liquids to separate from the hydrocarbon oils. These fluids are then ejected via gas and liquid purge lines 76 and 78. The condensed, partially hydrogenated liquids are then transferred by means of a pump 80 to the top of the fixed bed reactor 14 where they pass downwardly, along with the vapors from the ebullating bed reactor 62, for final hydrogenation. The remainder of the system shown in FIG. 3 operates in the same manner as the corresponding portion of the systems of FIGS. 1 and 2.

If desired, the partial pressure of the various constituents of the flow entering the flash evaporator tank 68 can be lowered to facilitate their evaporation in the tank by injection of steam along a steam feed line 82 to the input of the tank 68. The water which results from condensing this steam in the cooler 72 may be removed via the liquid purge line 78.

Figure 4:
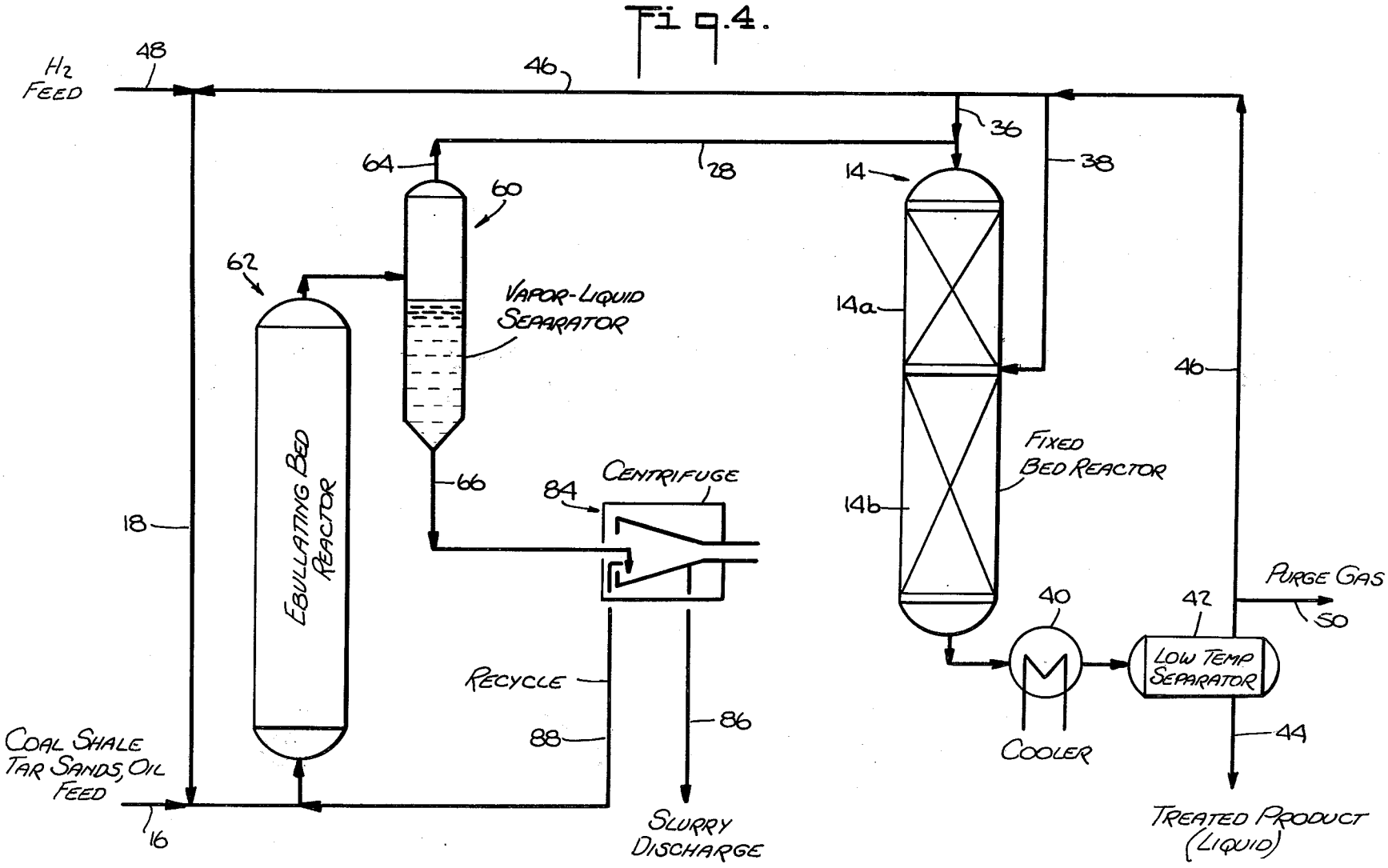
FIG. 4 is a view similar to FIG. 1 and showing a third modification.

FIG. 4 shows a still further arrangement which permits the further hydrogenation of the fines bearing hydrocarbonaceous material after it has passed through the ebullating bed reactor 62 and through separator 60. In the arrangement of FIG. 4 the liquid portion with entrained fines from separator 60 is passed through a centrifuge 84 which concentrates the fines and ejects them with a small amount of liquid in the form of a slurry via a slurry discharge line 86. Although the fines concentration in the slurry may be varied by the centrifuge 84 it is preferred to eject these fines in a slurry in which they constitute about 50% of the total weight. This ejected slurry may be burned.

The remaining liquids from the centrifuge 84 are transferred via a recycle line 88 back into the bottom of the ebullating bed reactor where they are further hydrogenated and where the remaining fines become transferred to new oil entering the system.

It will be appreciated that each of the above described systems for hydrogenation of hydrocarbonaceous material achieve substantially complete fines separation from the finished product with a minimum of effort and expense while maximizing the yield from a given quantity of feedstock. These systems obtain such results by partially hydrogenating and vaporizing the incoming hydrocarbonaceous material in a first stage ebullating bed reactor separating the vapors and completing their hydrogenation, concentrating and removing a slurry of fines from the liquid which has passed through the first stage reactor and vaporizing and completing the hydrogenation of such liquid.

Having thus described the invention with particular reference to the preferred forms thereof, it will be obvious to those skilled in the art to which the invention pertains that various changes and modification may be made therein without departing from the spirit and scope of the invention as defined by the claims appended hereto.

What is claimed and desired to be secured by letters patent is:

1. A method of treating hydrocarbonaceous material by hydrogenation to separate oxygen, sulfur and nitrogen and removal of fines, said method comprising the steps of (a) partially hydrogenating said material by passing it through ebullating catalytic bed reactor means along with hydrogen gas while allowing vaporization of some of said material during the hydrogenation reaction, but retaining a sufficient amount of said material in liquid form as a liquid portion to carry the accompanying fines through the reactor means, (b) separating the vapors from said liquid portion and accompanying fines transferred from said ebullating bed reactor means and subjecting said vapors to further hydrogenation, (c) concentrating said fines into a part of said liquid portion in step (b) to form a slurry and ejecting said slurry from said liquid portion, (d) subjecting another part of said liquid portion from step (b) to further hydrogenation.

2. A method according to claim 1 wherein said vapors are subjected to further hydrogenation in a fixed bed reactor.

3. A method according to claim 2 wherein the products from said fixed bed reactor are subjected to fractional separation and wherein hydrogen gas recovered therefrom is recycled back to said ebullating bed reactor means.

4. A method according to claim 1 wherein said another part of said liquid portion is combined with vapors which have been produced in said ebullating bed reactor means and is subjected to further hydrogenation.

5. A method according to claim 1 wherein step (d) is carried out by recycling the liquid portion remaining after step (c) through said ebullating bed reactor means.

6. A method according to claim 1 wherein step (a) of partially hydrogenating said hydrocarbonaceous material is carried out in stages by passing the oil serially through a plurality of separate ebullating bed reactors.

7. A method according to claim 6 wherein step (c) of concentrating said fines is performed separately on the liquid portion from each stage of said plurality of separate ebullating bed reactors.

8. A method according to claim 7 wherein said another part of said liquid portion from step (b) which precedes a successive ebullating bed reactor is further hydrogenated by passing said another part through said successive ebullating bed reactor.

9. A method according to claim 1 wherein the liquid portion remaining in step (a) has a fines concentration in the range of ten to twenty-five percent.

10. A method according to claim 1 wherein the liquid portion remaining in step (a) has a fines concentration of about twenty percent.

11. A method according to claim 1 wherein step (c) of concentrating said fines is carried out until the slurry thus formed and which is ejected has a fines concentration of about fifty percent.

12. A method according to claim 1 wherein said step of concentrating said fines is carried out by settling.

13. A method according to claim 1 wherein said step of concentrating said fines is carried out by centrifuging.

14. A method according to claim 1 wherein vapor is separated from step (c) by flashing said liquid portion.

15. A method according to claim 14 wherein the vapors produced in said flashing are condensed and the resulting liquid is separated from accompanying noncondensible gases and said liquid is added to said vapors which are further hydrogenated in step (b).

16. A method according to claim 15 wherein said liquid portion is heated prior to flash evaporation.

17. A method according to claim 16 wherein steam is injected into said liquid portion prior to said flash evaporation and wherein water produced in the course of condensation of said vapors is separated from the resulting liquid.

* * * * *